United States Patent [19]

Daniels et al.

[11] 4,247,305

[45] Jan. 27, 1981

[54] ABRASIVE STRUCTURES AND METHODS OF THEIR PREPARATION

[75] Inventors: William H. Daniels, Delaware, Ohio; Mahlon D. Dennis, Kingwood, Tex.; Earl Feingold, King of Prussia, Pa.

[73] Assignee: General Electric Company, Worthington, Ohio

[21] Appl. No.: 61,195

[22] Filed: Jul. 27, 1979

[51] Int. Cl.[3] ..... B24D 3/02

[52] U.S. Cl. ..... 51/307; 51/293; 51/297; 51/309

[58] Field of Search ..... 51/307, 297, 293, 309

[56] References Cited

U.S. PATENT DOCUMENTS

| | | | |
|---|---|---|---|
| 4,063,909 | 12/1977 | Mitchell | 51/309 |
| 4,108,614 | 8/1978 | Mitchell | 51/309 |
| 4,156,329 | 5/1979 | Daniel et al. | 51/295 |

*Primary Examiner*—Donald J. Arnold
*Assistant Examiner*—W. Thompson
*Attorney, Agent, or Firm*—Douglas B. Little; Richard J. Mazza

[57] ABSTRACT

Composite compacts comprising a cluster of abrasive particles selected from among diamond, cubic boron nitride and wurtzite boron nitride on a support medium, are securely bonded to metal tool parts by a process comprising providing a bond initiator between, and in contact with, a surface of the composite compact and a surface of the tool part, passing a short duration, high electrical current pulse through the contacting surfaces sufficient to cause melting of the bond initiator without raising the temperature of the abrasive particles to their decomposition temperature, forcing the composite compact and tool part together under an applied magnetic force pulse while the bond initiator is molten, and recovering the article.

3 Claims, 3 Drawing Figures

ABRASIVE STRUCTURES AND METHODS OF THEIR PREPARATION

This invention relates to articles useful in applications requiring wear-resistance, e.g., shaping, cutting, abrading, drilling, and the like, and methods of the preparation of such articles. More specifically, abrasive structures are prepared using a unique procedure employing in combination, a highly localized thermal melting event and magnetic force impaction. Bond strengths comparable to those of conventional brazing are achieved, but without the danger of thermally degrading the abrasive particles.

BACKGROUND OF THE INVENTION

Composite compact articles comprising a cluster of abrasive particles bonded to a support medium are known in the art. These are widely useful in a variety of industrial applications, such as shaping, extruding, cutting, abrading, drilling, and the like.

Special mention is made of abrasive particle clusters comprising diamond, cubic boron nitride (CBN), wurtzite boron nitride (WBN) or mixtures of any of the foregoing. These are known to possess very good abrasion and wear-resistance properties. Clusters of this type can be made by following procedures in the patent literature, e.g., Bovenkerk, U.S. Pat. No. 3,136,615, Wentorf, Jr., U.S. Pat. No. 3,609,818 and Wentorf, Jr., et al, U.S. Pat. No. 3,233,988, incorporated herein by reference.

Such abrasive particle clusters are made into composite compact articles by bonding the cluster to a metal or cemented tungsten carbide support, usually under conditions of temperature and pressure at which the abrasive particles are crystallographically stable. Such particles are commercially available and methods of preparation are described in the patent literature, e.g., Wentorf, Jr. and Rocco, U.S. Pat. No. 3,745,623 and U.S. Pat. No. 3,743,489 and Mitchell, U.S. Pat. No. 4,063,909, which are incorporated herein by reference.

Tools made with the composite compact are manufactured in the usual case by brazing a surface of the support portion of the compact to a surface of a steel tool shank or indexable type insert made either from steel or tungsten carbide. This bonding may be achieved by means of a low temperature braze, e.g., at a temperature of about 700° C. or lower. Such brazing, however, is not always satisfactory because the bond strengths are insufficient for certain commercial applications.

Brazing at higher temperatures, on the other hand, although resulting in higher bond strengths, sometimes approaches or exceeds temperatures at which the abrasive particles are thermally unstable. Using conventional high temperature brazing methods, it is often difficult to prevent the decomposition of at least some of the abrasive particles without taking special precautions.

There has now been discovered a method of joining composite compacts of abrasive particles to tool parts without subjecting the abrasive particles to elevated temperatures significantly above ambient. Bond strengths comparable to those of conventional brazing are achieved. Moreover, after the procedure has been completed, depending upon the conditions employed, substantially no brazing material can be caused to remain between the joined surfaces as a region of low resistance susceptible to erosion-type failure during normal use.

DESCRIPTION OF THE INVENTION

According to this invention, there is provided an improvement in the method of joining tool parts, including tool holders, drilling bit bodies, and the like, to composite compacts comprising a cluster of abrasive particles selected from among diamond, cubic boron nitride and wurtzite boron nitride on a cemented tungsten carbide support. The improvement comprises:

(a) providing a bond initiator between, and in discrete contact with, a surface of the cemented tungsten carbide support and a surface of the tool part;

(b) passing a short duration electrical current pulse from a discharging capacitor through the contacting surfaces sufficient to cause the bond initiator to melt but without raising the temperature of the abrasive particles to their thermal damage temperature threshold;

(c) forcing the surface of the composite compact and the surface of the tool part together under an applied short duration magnetic force pulse initiated from a discharging capacitor while the bond initiator is still molten; and (d) recovering the article comprising the composite compact securely bonded to the tool part.

This invention also includes bonded articles prepared by the foregoing process.

As employed herein, the term "bond initiator" refers to a metallic material which, upon use under the specified conditions, is capable of producing a bond having a shear strength of about 35,000 pounds per square inch (psi) between the joined surfaces. This is a heat consumable metallic material capable of being substantially consumed during the process.

Preferably, the bond initiator is a metal or combination of metals having a melting point of at least about 500° C., more preferably at least about 700° C., and usually between about 650° and 1800° C., or higher.

Illustratively, the bond initiator is selected from metals such as aluminum, cobalt, copper, iron, chromium, nickel, gold, silver, palladium and tungsten, as well as mixtures or alloys of any of these.

Special mention is made of alloys comprised of metals which when present in appropriate proportions and supplied with sufficient external energy to initiate chemical combination, exothermically release large amounts of energy, e.g., of the order of 2,000 calories per cubic centimeter (cal/cm$^3$) or more, and sufficient to melt the alloy. These are well known in the art. Examples include platinum-aluminum (Pt-Al), titanium-boron (Ti-$B_2$), zirconium-boron (Zr-$B_2$), nickel-aluminum (Ni-Al), gold-palladium-nickel (Au-Pd-Ni), and gold-copper-zinc-cadmium-nickel (Ag-Cu-Zn-Cd-Ni). These can be used as such, or together with elemental metals, including any of the aforementioned.

The bond initiator is employed in a form such that a point or points of discrete, i.e., discontinuous, contact between the surfaces to be joined is provided, e.g., as a wire, cube, truncated cone, screen, or the like. The bond initiator may be machined onto one of the surfaces, most often the tool part surface, projecting outwardly therefrom. As a consequence, the application of a sufficient electrical current pulse through the contacting surfaces results in a massive electrical discharge at the point of contact between the bond initiator and the second surface, releasing thermal energy and causing the bond initiator to melt.

An advantage provided by this procedure is that the thermal energy thus produced, though sufficient to melt the bond initiator, is also almost instantaneously dissipated at the point of contact in a plane between the two contacting surfaces. As a result, the unjoined surface of the composite compact, comprising exposed abrasive particles, remains at or about ambient temperature, e.g., less than 50° C., without the need for externally supplied cooling.

DETAILED DESCRIPTION OF THE DRAWINGS

Figure 1:
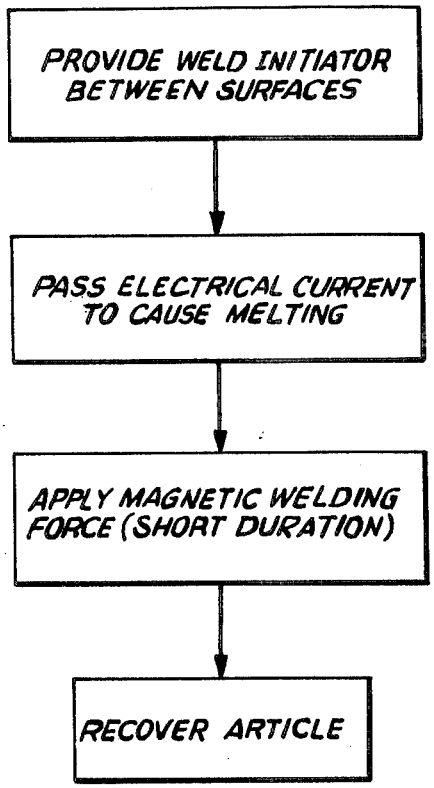
FIG. 1 is a block diagram of the process of the invention.

With reference to FIG. 1, in accordance with the invention a bond initiator is provided between the two surfaces to be joined, i.e., a surface of the cemented tungsten carbide support of a composite abrasive compact and a surface of the tool part. A single pulse of electrical current from a controlled capacitor discharge current source is passed through the contacting surfaces at power levels which result in a discharge sufficient to melt and/or to volatilize the bond initiator. The surface of the composite abrasive compact and the surface of the tool part are forced together under the influence of an applied magnetic force of short duration, either simultaneously with, or shortly after melting has been induced. The resulting article, comprising the composite compact and tool part firmly joined at their respective surfaces, is recovered.

Figure 2:
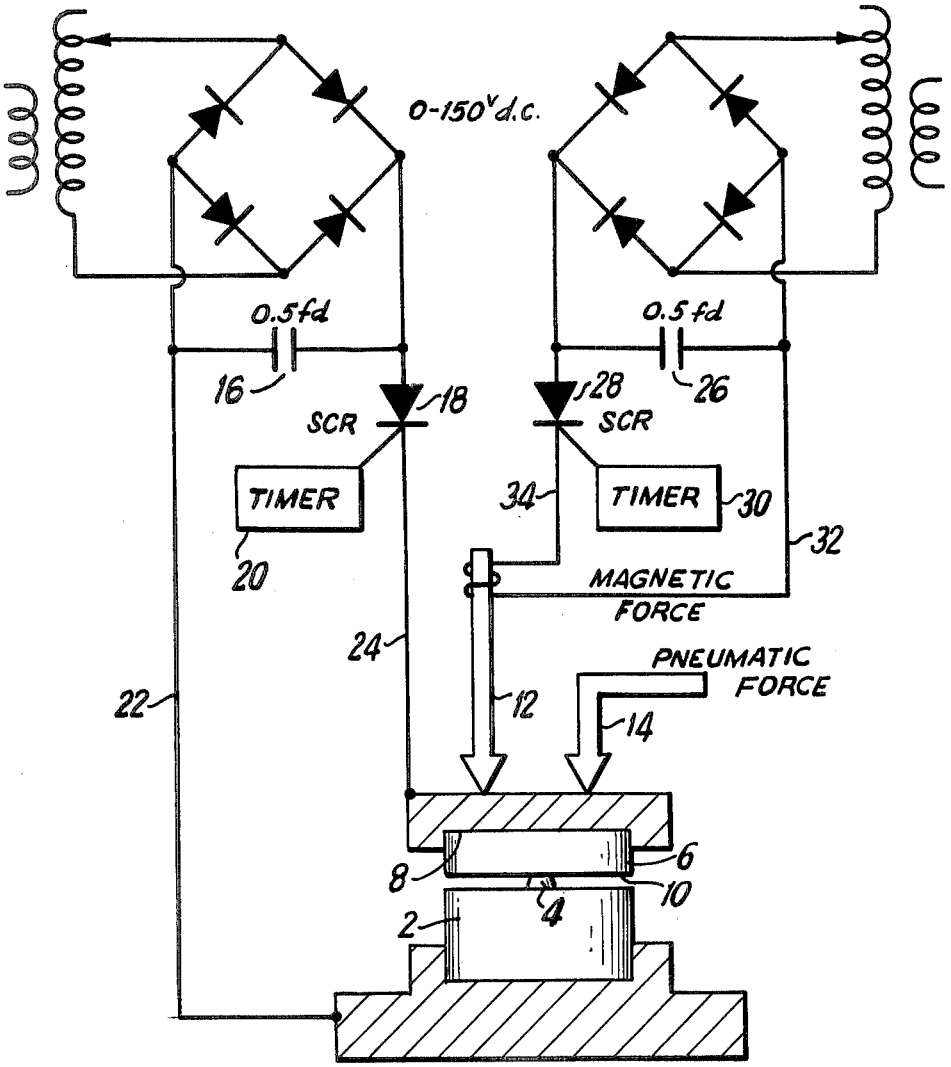
FIG. 2 is a schematic diagram of a system for carrying out the process of the invention.

With reference to FIG. 2, a stud or other cutting tool support 2, having an appropriate bond initiator 4 on the surface, and composite compact 6, comprising abrasive particle surface 8 facing away from bond initiator 4 and tungsten carbide surface 10 facing towards bond initiator 4 and in contact therewith, are placed between magnetic clamps 12, e.g., 6.5-inch magnetic force head and C-frame, 9999-00, manufactured by Teledyne Precision, Cincinnati, Ohio, or equivalent. Clamps 12 are in movable contact with pneumatic assembly 14. Clamps 12 and pneumatic assembly 14 hold the working surfaces of a stud or other tool holder 2 and bond initiator 4 together. An applied pneumatic force equivalent to from about 10 to about 800 pounds of force is ordinarily sufficient for this purpose. Instead of pneumatically operated clamps, mechanically operated fixtures can be used.

To melt bond initiator 4, a high current pulse which may be either positive or negative is applied from current source 16, which is a charged electrical capacitor, through switching system 18, an SCR, caused to be conductive by timing circuit 20, and leads 22 and 24. Leads 22 and 24 are in contact with tool holder 2 and composite compact 6, respectively. In general, a current having an amplitude of up to about 50,000 amperes, and usually from about 5,000 to about 30,000 amperes, and a pulse width of between about 0.001 and 0.005 second, is employed. The large quantity of thermal energy made available at the bonding interface during joining is sufficient to melt, and even volatilize the bond initiator and constituents of the surfaces of the materials being joined.

While the bond initiator is still molten, a magnetic force pulse sufficient to bring the surface of tool holder 2 and the surface of composite compact 6 flush against each other is applied to the workpiece. This is done by applying a second current pulse, from a charged capacitor current source 26 through switching circuit, 28, an SCR, initiated by timer circuit 30, and leads 32 and 34 attached to magnetic clamps 12. A magnetic force is thus created, causing magnetic clamps 12 to close towards each other and force tool holder 2 and composite compact 6 together.

Preferably, a magnetic force pulse having a controlled amplitude sufficient to provide from about 100 to 3,000 pounds of pressure, and having a duration of from about 0.0001 to 0.005 seconds, is used. By regulating solid state switches, SCR's, 18 and 28, through timing circuits 20 and 30, the relative phase between the bonding current pulse (that which is used to melt the bond initiator) and the magnetic force pulse (that which is used to force the working surfaces together under an applied magnetic force) can be controlled to coincide, or to be applied in tandem.

Because the duration of the procedure is relatively brief, e.g., of the order of hundredths of a second, the resulting bonded material, except for a narrow bonding or brazing zone, remains at or near ambient temperature throughout the procedure. Almost immediately after the surfaces have been joined and the bonded article formed, it is observed that the article is at room temperature. It is estimated that the surface of the workpiece in vertical cross-section only 3 millimeters away from, and parallel to, the weld or braze line rises no more than 10° C. above the ambient temperature, and well below the decomposition temperature of the abrasive particles.

Typically, the resulting joint has a shear strength of at least about 35,000 psi, and usually from about 35,000 to about 45,000 psi. If a heat consumable material is used as the bond initiator, through careful choice of initiator geometry and operating conditions, substantially no bond initiator material can be caused to remain between the bonded surfaces.

Figure 3:
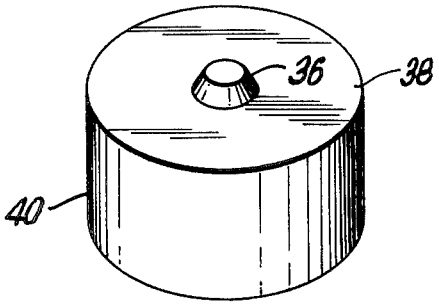
FIG. 3 illustrates one of two parts to be joined in the process, the part having a bond initiator machined onto a surface of the part.

In an embodiment shown in FIG. 3, the bond initiator is in the form of a small truncated cone 36, which has been machined onto surface 38, of tool part 40. The bond initiator is not limited to this configuration, it may or may not be machined onto the surface of the tool part. It may be, but not limited to, a cylinder, spindle, wire, washer, screen, etc.

DESCRIPTION OF THE SPECIFIC EMBODIMENTS

The processes and articles of the invention are illustrated further in the following example. This is not intended to be limiting.

EXAMPLE

Using a tungsten carbide, CARBOLOY®, grade 55B, stud in the shape of a cylinder having a flat top surface, a substantially flat bottom surface, 0.38 inch high and a diameter of about 0.52 inch, a stainless steel screen bond initiator is used. The initiator is 0.375 inch in diameter, 40 mesh, composed of 0.01 inch diameter steel wire. The tungsten carbide stud is placed in a 6.5-inch diameter capacitor discharge joiner gun. A composite compact comprising a disc having a layer of bonded diamond abrasive particles on a support layer of cobalt cemented tungsten carbide (a STRATAPAX® compact obtained from General Electric Company), with a thickness of 0.125 inch and a diameter of 0.523 inch, is also placed in the joiner gun such that the flat surface of the cemented tungsten carbide layer of the Stratapax compact is flush against the surface of the initiator screen which in turn is flush against the tungsten carbide stud.

The surfaces are then joined using the following parameters:

| | |
|---|---|
| Air gap | 0.10 inch |
| Magnet capacitor* voltage | 50 volts |
| Magnet delay control | 50 percent |
| Pneumatic force | 200 pounds |
| Weld capacitor* voltage | 52 |
| Capacitor discharge pulse duration | 0.005 seconds |
| Polarity | cutting element negative |

*charging capacitors, 0.5 Farad each

It is observed that substantially no degradation of the abrasive particles in the composite compact occurs during bonding. After bonding, the shear strength is evaluated using an Instron Testing Machine at a strain rate of 0.02 inch/minute or a Tinnius Olsen Testing Machine at a strain rate of 0.05 inch/minute, and found to be greater than 28,000 psi.

Other modifications and variations of this invention are possible. For instance, instead of the particular bond initiator described, a wire of the same metal or other metal, e.g., copper wire, can be inserted between the two surfaces to be joined. Instead of a tungsten carbide stud, a metal stud or tool holder or drilling bit body can be substituted. Instead of diamond abrasive particles, cubic boron nitride or wurtzite boron nitride abrasive particles can be used.

The invention in its broadest aspect, therefore, is not limited to the specific procedures and materials shown and described but departures may be made therefrom within the scope of the accompanying claims without departing from the principles of the invention or sacrificing its chief advantages.

We claim:

1. In a method of joining a tool part to a composite compact comprising a layer of bonded abrasive particles selected from diamond, cubic boron nitride and wurtzite boron nitride bonded to a cemented tungsten carbide support, which method normally comprises brazing the composite compact to the tool part, the improvement which comprises the application of an electrical current pulse and magnetic force impaction in the following manner:

(a) disposing the tool part and the composite compact, having a bond initiator between them with a melting point of at least 700° C. and in such a form that discrete, discontinuous contact with both tool part and the composite compact is provided,
  (i) in electrical contact with a high current pulse source, and also
  (ii) between magnetic clamps;

(b) passing a single high current pulse, of between about 5,000 and about 30,000 amperes, through the tool part, the bond initiator and the composite compact for a time of from 0.001 to 0.005 seconds; and (c) forcing the composite compact and the tool part together under an applied magnetic force providing from about 100 to about 3,000 pounds per square inch pressure for a duration of about 0.001 to 0.005 seconds while the bond initiator is molten;

whereby a bond between the composite compact and the tool part having a shear strength of over 28,000 pounds per square inch is obtained.

2. The improved method as recited in claim 1 wherein the bond initiator of subpart (a) is a metal alloy which, under the conditions of this improved method, exothermically releases relatively large amounts of energy greater than or equal to 2000 calories per cubic centimeter and sufficient to melt the alloy.

3. The improved method as recited in claim 2 wherein the bond initiator is selected from the following types of alloys: platinum-aluminum, titanium boron, zirconium-boron, nickel-aluminum, gold-palladium-nickel, and gold-copper-zinc-cadmium-nickel.

* * * * *